US009302477B2

(12) United States Patent
Toya

(10) Patent No.: US 9,302,477 B2
(45) Date of Patent: Apr. 5, 2016

(54) PRINTING APPARATUS

(71) Applicant: SEIKO EPSON CORPORATION, Tokyo (JP)

(72) Inventor: Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/208,917

(22) Filed: Mar. 13, 2014

(65) Prior Publication Data

US 2014/0292868 A1 Oct. 2, 2014

(30) Foreign Application Priority Data

Mar. 27, 2013 (JP) ..... 2013-065800

(51) Int. Cl.
*B41J 29/38* (2006.01)
*B41J 2/07* (2006.01)
*B41J 2/21* (2006.01)

(52) U.S. Cl.
CPC *B41J 2/07* (2013.01); *B41J 2/2114* (2013.01); *B41J 2/2128* (2013.01)

(58) Field of Classification Search
CPC ..... B41J 2/07; B41J 2/0458; B41J 2/04563; B41J 29/393; B41J 2/04591; B41J 2/04581; B41J 2/175; B41J 2/2114
USPC ..... 347/9, 14, 16, 19
See application file for complete search history.

(56) References Cited

U.S. PATENT DOCUMENTS 6,474,778 B1 * 11/2002 Koitabashi et al. ..... 347/43
6,517,191 B1 * 2/2003 Koitabashi ..... 347/43
2011/0285769 A1 * 11/2011 Ito ..... 347/9
2011/0310160 A1 * 12/2011 Jogo et al. ..... 347/19

FOREIGN PATENT DOCUMENTS

JP 2002-307755 10/2002

* cited by examiner

*Primary Examiner* — Jason Uhlenhake
(74) *Attorney, Agent, or Firm* — Workman Nydegger

(57) ABSTRACT

Provided is a printing apparatus including a head and a control unit. The head ejects, onto a printing medium, an image forming liquid for forming an image and an ancillary liquid ancillary to forming of the image performed by the image forming liquid. The control unit performs control so as to cause the head to perform a first operation of ejecting the image forming liquid onto a first region of the printing medium, and a second operation of ejecting the ancillary liquid onto a second region of the printing medium, the second region being different from the first region. Further, the control unit performs control so as to cause the head to perform the second operation in an anterior pass and perform the first operation in a posterior pass.

5 Claims, 9 Drawing Sheets

PRINTING APPARATUS

BACKGROUND

1. Technical Field

The present invention relates to a printing apparatus.

2. Related Art

As printing apparatuses, ink jet type printers which form images by ejecting ink onto a printing medium have been well known.

Among such ink jet type printers, there has been an ink jet type printer which performs printing using colored inks, such as CMY inks, and a colorless transparent ink (a clear ink).

JP-A-2002-307755 is an example of related art.

Here, a film type medium made of polystyrene, polypropylene or the like is sometimes used as a printing medium. Such a film type medium is likely to, inside a printer, cause electrostatic charges on its surface due to a friction with a paper-feeding roller made of a metallic material (an aluminum material, an iron material or the like). Further, an amount of the electrostatic charges is influenced by a state of the friction and thus varies depending on a position on the surface of the medium.

When an ink is ejected onto such a printing medium on which the variation of the amount of electrostatic charges is occurring, ink mists (so-called satellites) which arise in conjunction with the ink ejection are accumulated on regions in each of which the amount of electromagnetic charges is large. As a result, sometimes, haze-like image degradations occur on printed materials.

Meanwhile, it is possible to reduce the amounts of electrostatic charges to a substantially uniform amount by applying an ancillary ink, such as a clear ink, to the entire surface of a printing medium in advance.

Nevertheless, there is a problem that, when such a clear ink is applied to the surface of a printing medium, an image forming liquid (a colored ink) and the clear ink are mixed with each other, so that blurs occur on images.

SUMMARY

An advantage of some aspects of the invention is to provide a printing apparatus which enables reduction of blurs on images even when an ancillary liquid (a clear ink or the like) is used.

Provided in accordance with a main aspect of the invention is a printing apparatus including a head and a control unit. The head ejects, onto a printing medium, an image forming liquid for forming an image and an ancillary liquid ancillary to forming of the image performed by the image forming liquid. The control unit performs control so as to cause the head to perform a first operation of ejecting the image forming liquid onto a first region of the printing medium, and a second operation of ejecting the ancillary liquid onto a second region of the printing medium, the second region being different from the first region. Further, the control unit performs control so as to cause the head to perform the second operation in an anterior pass and perform the first operation in a posterior pass.

Other aspects of the invention will become apparent from description of this specification and accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Outline of Disclosure

At least the following matters will become apparent from description of this specification and the accompanying drawings.

That is, a printing apparatus that will become apparent hereinafter includes a head configured to eject, onto a printing medium, an image forming liquid for forming an image and an ancillary liquid ancillary to forming of the image performed by the image forming liquid; and a control unit configured to perform control so as to cause the head to perform a first operation of ejecting the image forming liquid onto a first region of the printing medium, and a second operation of ejecting the ancillary liquid onto a second region of the printing medium, the second region being different from the first region, and the control unit performs control so as to cause the head to perform the second operation in an anterior pass and perform the first operation in a posterior pass.

Such a printing apparatus makes it possible to reduce blurs on images even when the ancillary liquid is used.

Further, in the printing apparatus that will become apparent hereinafter, the control unit includes a calculation unit for calculating a coverage ratio of the image on the printing medium on the basis of image data corresponding to the image, and in the case where the coverage ratio is smaller than or equal to a threshold value, the control unit performs control so as to cause the head to also eject the ancillary liquid onto the first region.

Such a printing apparatus enables reduction of the influence of satellites even when the coverage ratio is low (for example, when a gradation image is printed).

Further, in the printing apparatus that will become apparent hereinafter, the control unit is capable of selectively performing a plurality of modes which are mutually different in an amount of ejection of the ancillary liquid in the second operation.

Such a printing apparatus enables selection of an amount of ejection of the ancillary liquid.

Further, the printing apparatus that will become apparent hereinafter further includes a measurement portion configured to measure humidity of the printing medium, and in the case where a result of the measurement performed by the measurement portion is smaller than or equal to a threshold value, the control unit performs control so as to cause the head to increase an amount of ejection of the ancillary liquid.

Such a printing apparatus enables increase of an amount of ejection of the ancillary liquid when humidity is low.

Further, in the printing apparatus that will become apparent hereinafter, in the case where there exists a region which is the second region and is to be detached after subjected to printing of the image, the control unit performs control so as to cause the head not to perform the second operation on the region to be detached.

Such a printing apparatus makes it possible to cause satellites to be selectively accumulated on the region to be detached.

Configuration of Printing Apparatus

Figure 1:
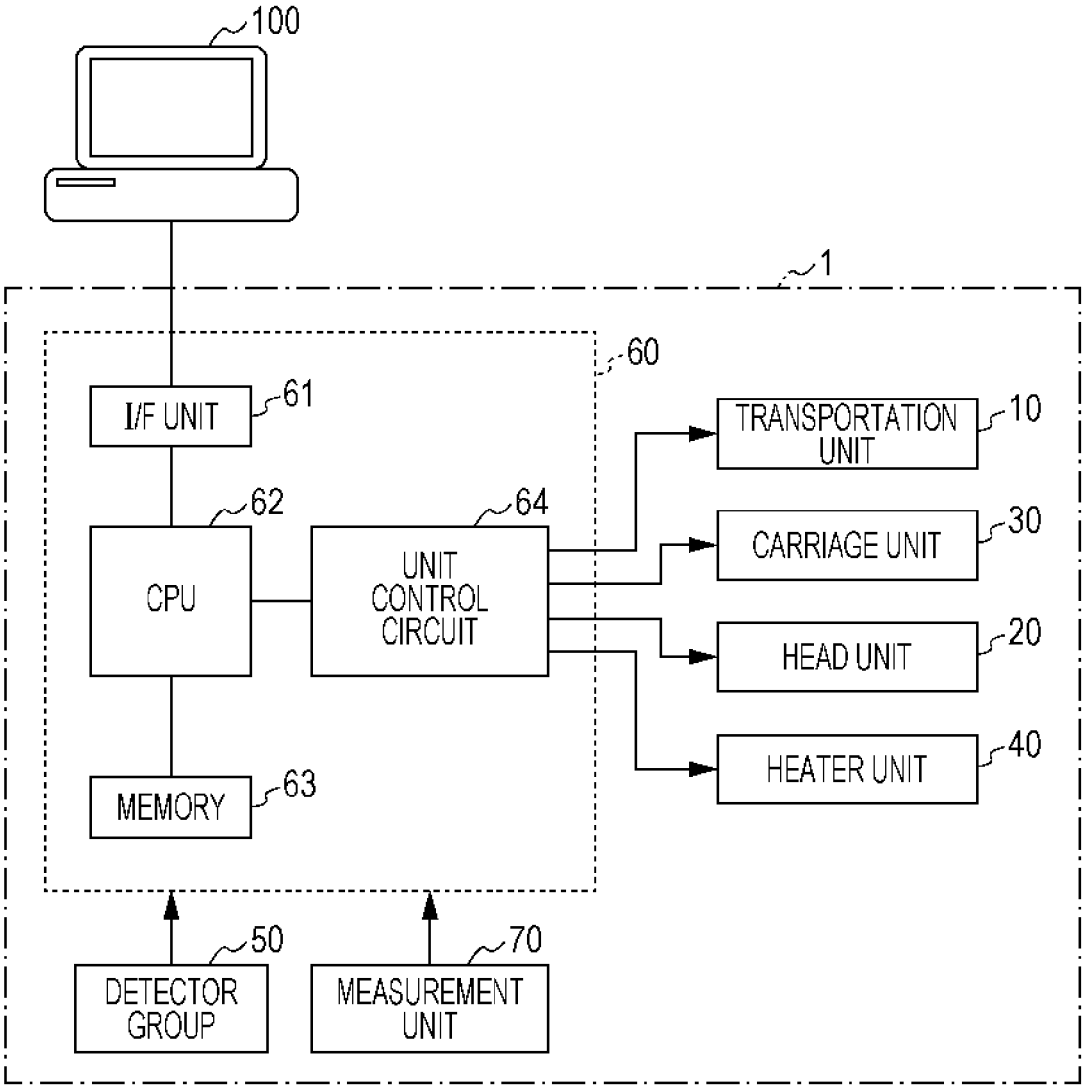
FIG. 1 is a diagram illustrating a configuration of a printing apparatus according to an embodiment of the invention.
Figure 2:
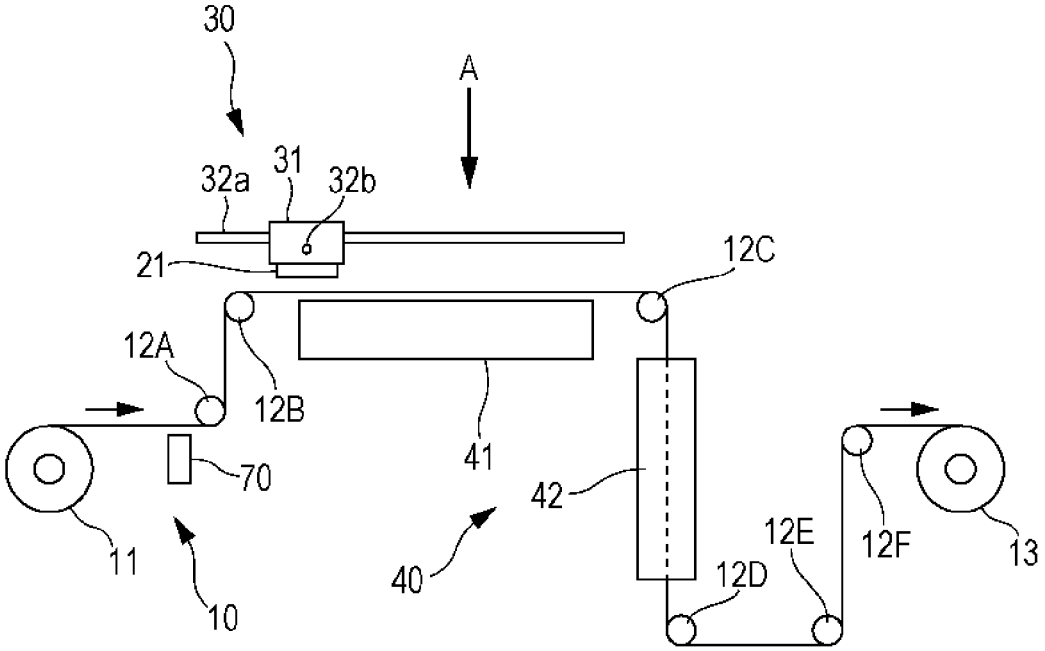
FIG. 2 is a diagram illustrating a configuration of a printing apparatus according to an embodiment of the invention.
Figure 3:
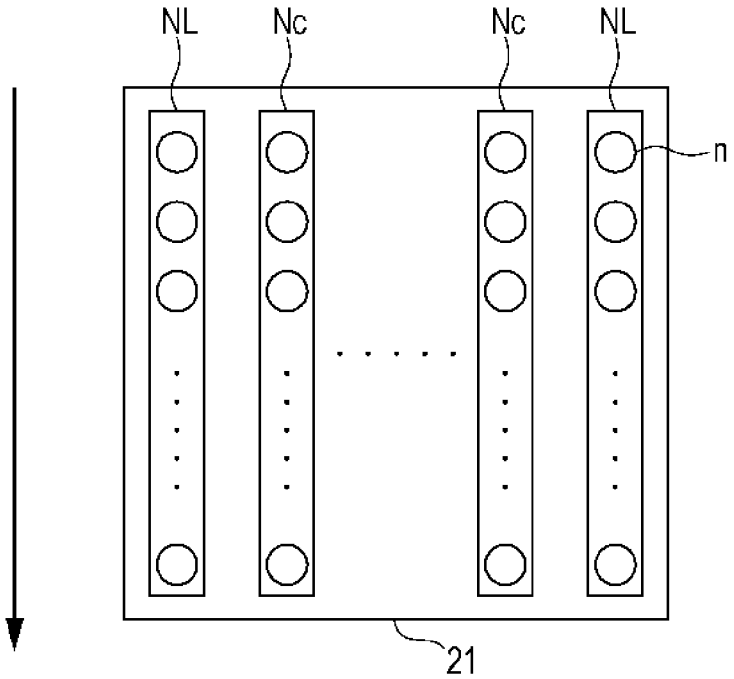
FIG. 3 is a diagram illustrating a configuration of a printing apparatus according to an embodiment of the invention.
Figure 4:
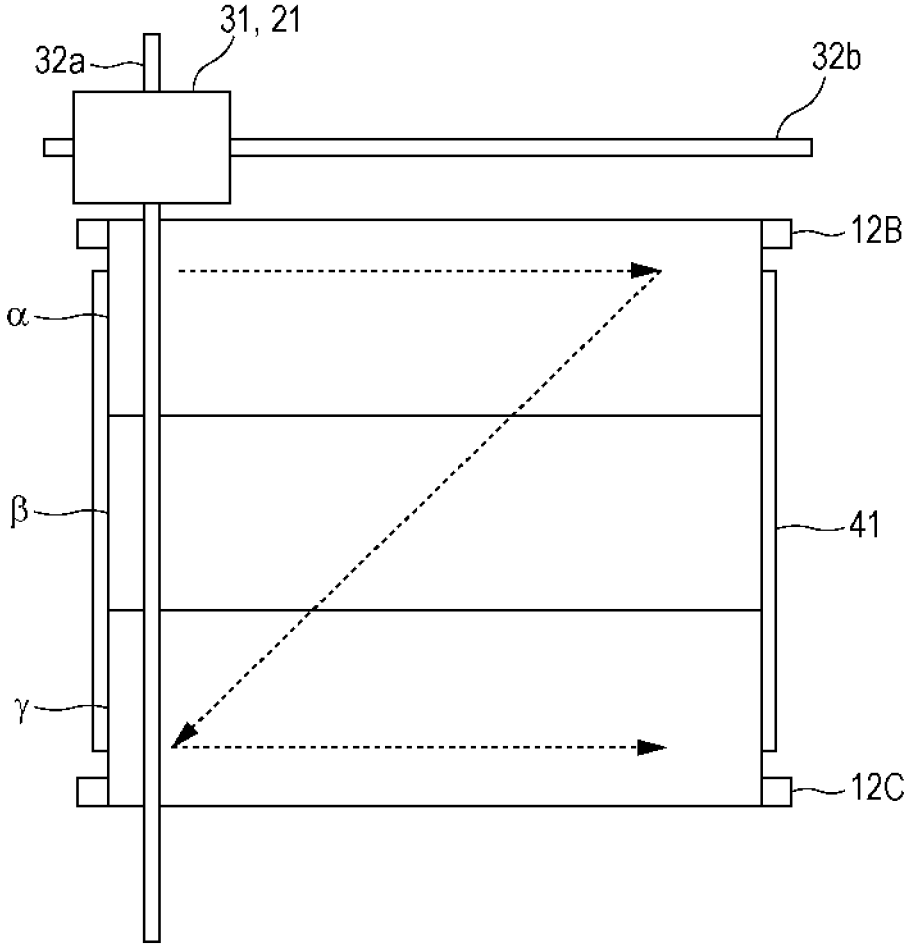
FIG. 4 is a diagram illustrating a configuration of a printing apparatus according to an embodiment of the invention.

A configuration of a printing apparatus according to this embodiment will be described with reference to FIGS. 1 to 4. In this embodiment, an ink jet printer 1 based on a lateral method (described below) will be described as the printing apparatus. FIG. 1 is a block diagram illustrating the whole configuration of the ink jet printer 1. FIG. 2 is a schematic diagram illustrating a configuration of part of the ink jet printer 1. FIG. 3 is a diagram illustrating an example of a head 21 (described below). FIG. 4 is a diagram of a printing medium when viewed from the direction A of FIG. 2. In FIG. 4, part of the configuration shown in FIG. 2 is omitted.

The ink jet printer 1 includes a transportation unit 10, a head unit 20, a carriage unit 30, a heater unit 40, a detector group 50, a controller 60 and a measurement unit 70. When having received image data for printing from a computer 100 which is an external apparatus, the ink jet printer 1 performs control of the individual units (the transportation unit 10, the head unit 20, the carriage unit 30 and the heater unit 40) through the controller 60. The controller 60 performs control of the individual units on the basis of the image data having been received from the computer 100, and thereby forms (prints) images on a printing medium. The detector group 50 monitors and detects situations inside the ink jet printer 1. The detector group 50 outputs the results of the detections to the controller 60. The controller 60 performs control of the individual units on the basis of the results of the detections having been outputted from the detection group 50.

The transportation unit 10 unreels a printing medium wound in a roll form and transports the unreeled printing medium in a predetermined direction (hereinafter, sometimes, a direction in which a printing medium is transported will be referred to as "a transportation direction"). This embodiment will be described by way of an example in which a film type medium is used as the printing medium.

As shown in FIG. 2, the transportation unit 10 includes a feeding mechanism 11, transportation rollers 12A to 12F and a reeling mechanism 13. The feeding mechanism 11 feeds a printing medium to a side of a carriage unit 30 (a head unit 20). The transportation rollers 12A to 12F transport the printing medium fed from the feeding mechanism 11 up to a position where images are formed (printed) (hereinafter, sometimes, this position will be referred to as "a printing position"). Moreover, the transportation rollers 12A to 12F transport the printing medium, on which images have been formed at the printing position, up to the reeling mechanism 13. The reeling mechanism 13 reels the printing medium on which images are formed. In addition, in the ink jet printer 1, a side of the feeding mechanism 11 may be referred to as "an upstream side" and a side of the reeling mechanism 13 may be referred to as "a downstream side".

The head unit 20 includes a head 21. The head 21 of this embodiment ejects image forming liquids and an ancillary liquid onto a printing medium.

The image forming liquid is a liquid (for example, a color ink, such as a cyan ink, a magenta ink or a yellow ink) which is for use in forming of images on a printing medium. The ancillary liquid is a liquid (for example, a clear ink or a white ink) which is ancillary to forming of images performed by the image forming liquids. It is desirable that the ancillary liquid is such a kind of liquid that does not change any face quality of the printing medium.

The image forming liquids are ejected through nozzles n (described below) of the head 21, thereby causing images to be formed on a printing medium. Further, the ancillary liquid is ejected through nozzles n (described below) of the head 21, thereby causing ancillary liquid layers to be formed on the printing medium.

FIG. 3 is a schematic diagram illustrating a face of a printing-medium facing side of the head 21. An arrow shown in FIG. 3 denotes the transportation direction. As shown in FIG. 3, in the head 21 of this embodiment, a plurality of nozzle rows are provided so as to extend in the transportation direction. Specifically, in the head 21, a plurality of nozzle rows Nc for ejecting color inks as the image forming liquids are provided in a direction orthogonal to the transportation direction. A single nozzle row ejects the same colored color ink. Further, two nozzle rows NL, each ejecting a clear ink as the ancillary liquid, are provided so as to interpose the nozzle rows Nc therebetween. Each of the nozzle rows is composed of a plurality of nozzles n. A single nozzle n ejects a liquid corresponding to a single dot.

The carriage unit 30 causes the head unit 20 (the head 21) to move in a predetermined direction. As shown in FIGS. 2 and 4, the carriage unit 30 of this embodiment includes a carriage 31, a guide 32*a* and a guide 32*b*. The carriage 31 mounts the head unit 20 thereon. The guide 32*a* is a member for guiding the movement of the carriage 31 in the transportation direction. The guide 32*b* is a member for guiding the movement of the carriage 31 in a direction orthogonal to the transportation direction. The carriage 31 on which the head unit 20 is mounted can two-dimensionally move relative to a printing medium staying at the printing position by means of the guide 32*a* and the guide 32*b*. Hereinafter, a direction in which the carriage 30 (the head unit 20) moves may be referred to as "a movement direction". Dashed lines each having an arrow shown in FIG. 4 denote an example of the movement of the carriage unit 30 (the head unit 20).

Such a method that allows images to be formed by causing the head unit 20 to eject liquids onto a printing medium while, not transporting the printing medium, but causing the head unit 20 to move two-dimensionally (or may be one-dimensionally) relative to the printing medium is called "a lateral method". In the case where images are formed by means of the lateral method, forming of images based on image data on a printing medium staying at a printing position is already completed at the time of resuming transportation of the printing medium.

The heater unit 40 includes a hot platen 41 and a drying mechanism 42. The hot platen 41 is a member for supporting a printing medium at the printing position. Further, the hot platen 41 incorporates a heater, and through heating of a printing medium staying at the printing position, the hot platen 41 dries liquids (inks) forming images and ancillary liquid layers which have been formed on the printing medium. The drying mechanism 42 is provided at a more downstream side than the printing position, and through heating of the printing medium on which the images are formed, the drying mechanism 42 accelerates drying of the liquids (inks) forming the images and the ancillary liquid layers, at a position outside the printing position.

The detector group 50 includes a sensor (not illustrated) for detecting an amount of transportation of a printing medium performed by the transportation unit 10, an encoder for detecting an amount of rotations of a transportation roller (not illustrated) for transporting the printing medium, a linear type encoder for detecting a position of the carriage 31 in the movement direction, and the like.

The controller 60 is a controlling unit (the control unit) for controlling the ink jet printer 1. The controller 60 includes an interface (I/F) portion 61, a CPU 62, a memory 63 and a unit control circuit 64.

The interface portion 61 transmits and receives data between the computer 100 and the ink jet printer 1. The CPU 62 is an arithmetic processing unit for controlling the entire ink jet printer 1. The memory 63 secures a program storage area, a work area and the like for the CPU 62. Further, the memory 63 stores therein image data targeted for printing. In accordance with the programs stored in the memory 63, the CPU 62 performs control, through the unit control unit 64, so as to cause the individual units to perform various processes.

For example, as shown in FIG. 4, in accordance with the image data stored in the memory 63, the CPU 62 causes the head 21, through the unit control circuit 64, to move two-dimensionally (refer to the dashed lines each having an arrow, shown in FIG. 4). In this way, the ink jet printer 1 forms images and ancillary liquid layers for each of printing regions (printing regions $\alpha$ to $\gamma$) on a printing medium staying at the printing position. A printing region means a region on which necessary ones of the image forming liquids and the ancillary liquid are ejected (i.e., a region on which images and ancillary liquid layers are formed). A printing region in this embodiment corresponds to the whole of a printing medium staying at the printing position.

In addition, in this embodiment, the printing region is divided into a first region E1 and a second region E2. The first region E1 is a region onto which necessary ones of the image forming liquids are ejected (i.e., a region on which images is formed). The second region E2 is a region onto which any of the image forming liquids is not ejected (i.e., a region on which ancillary liquid layers are formed). The controller 60 can obtain the first region E1 and the second region E2 by analyzing image data. The first region E1 and the second region E2 are each composed of a plurality of pixel regions. This "pixel region" is a region existing on a printing medium and corresponding to a pixel on image data (the pixel and the pixel region corresponding to each other on a one-to-one basis). For example, in the case where resolution of image data is 360×360 dpi, "a pixel region" becomes a region having a shape of a square whose side is 1/360 inches in size.

The measurement unit 70 performs measurement of humidity of a printing medium. The measurement unit 70 is provided at, for example, a vicinity of the printing medium inside the ink jet printer 1 (refer to FIG. 2). The measurement unit 70 of this embodiment is an example of "the measurement portion".

In addition, the foregoing "measurement of humidity of a printing medium" includes both a direct measurement of humidity of the printing medium itself and a presumption of humidity of the printing medium itself by measuring humidity of an atmosphere surrounding the printing medium. Thus, the measurement unit 70 may be a means for directly measuring humidity of the printing medium itself or a means for presuming humidity of the printing medium by measuring humidity of an atmosphere surrounding the printing medium.

In the latter case, the means for presuming humidity of the printing medium (i.e., the measurement unit 70) may be a means for presuming humidity of the printing medium itself on the basis of an actually measured humidity of an atmosphere surrounding the printing medium and a humidity data table (stored in the memory 63 or the like) representing correspondence relations between preliminarily measured humidities of the atmosphere surrounding the printing medium and humidities of the printing medium itself. Moreover, the measurement unit 70 may be configured to, among atmospheres surrounding the printing medium, presume humidity of an atmosphere particularly being located at the upstream side of the printing position where the image forming liquids are ejected, and further being located on a transportation path for the printing medium.

Regarding Control of Ejection Operation

Next, control of liquid ejection operation in the ink jet printer 1 according to this embodiment will be described with reference to FIGS. 5A to 6D. FIGS. 5A to 6D are schematic diagrams each illustrating a printing medium staying at a printing position. An image (as well as a layer of an ancillary liquid L) on the printing medium is composed of a plurality of raster lines. One of the raster lines corresponds to a raw of dots aligning in a direction orthogonal to the transportation direction of the printing medium. "An n-th raster line" of this embodiment means a raster line located at an n-th position. Further, "a path" means an operation of forming dots by ejecting liquids from the head 21 (through the nozzles n of the head 21) in the state of moving. In FIGS. 5A to 6D, a liquid having been ejected (i.e., a dot) is denoted by a circle. Further, in FIGS. 5A to 6D, a square-shaped region in which a single dot is disposed denotes a single pixel region.

In the case where, for example, a film type medium is transported by the transportation unit 10, a friction occurs between the film type medium and each of the transportation roller 12A, the transportation roller 12B and the hot platen 41. As a result, electrostatic charges occur on the surface of the film type medium which has reached the printing position. Further, in general, there occurs a variation in amounts of the electrostatic charges on the surface of the film type medium because the amount of electrostatic charges varies depending on a state of the friction.

Accordingly, in order to cause the amounts of electrostatic charges on the surface of the film type medium to be uniform, it is desirable to apply the ancillary liquid.

Meanwhile, in the case where the ancillary liquid is applied to the surface of the printing medium, there is a possibility that the ancillary liquid and a certain one of the image forming liquids are mixed with each other, so that blurs occur on images.

Thus, the controller 60 of this embodiment (the control unit) performs control so as to cause the head 21 to perform an operation of ejecting the ancillary liquid onto the second region E2 (this operation being referred to as a second operation) in an anterior pass, and an operation of ejecting necessary ones of the image forming liquids onto the first region E1 (this operation being referred to as a first operation) in a posterior pass.

Figure 5A:
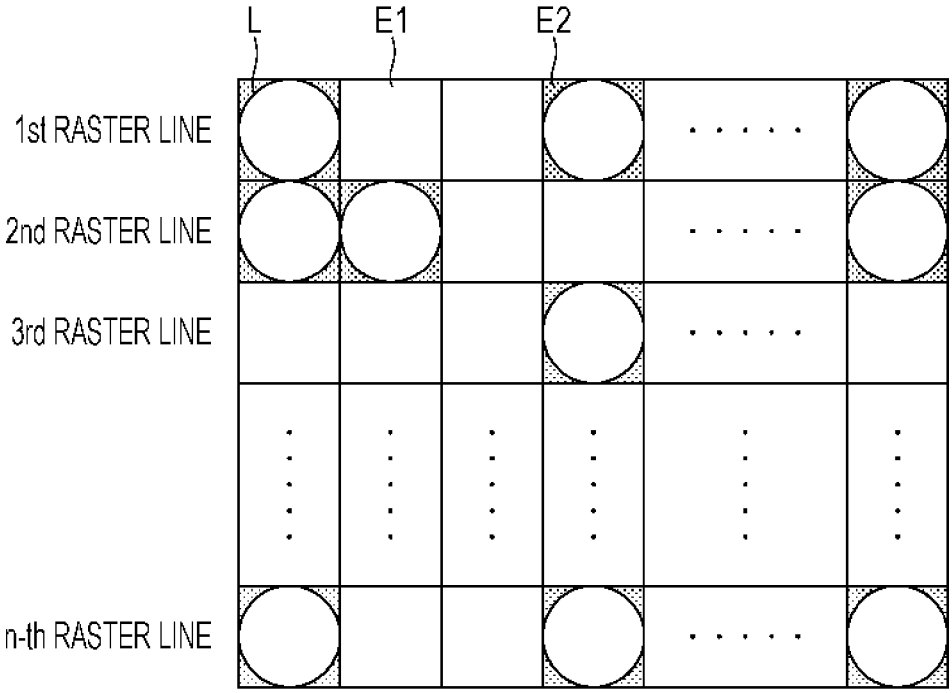
FIG. 5A is a diagram illustrating ejection operation of an ancillary liquid and an image forming liquid according to an embodiment of the invention.
Figure 5B:
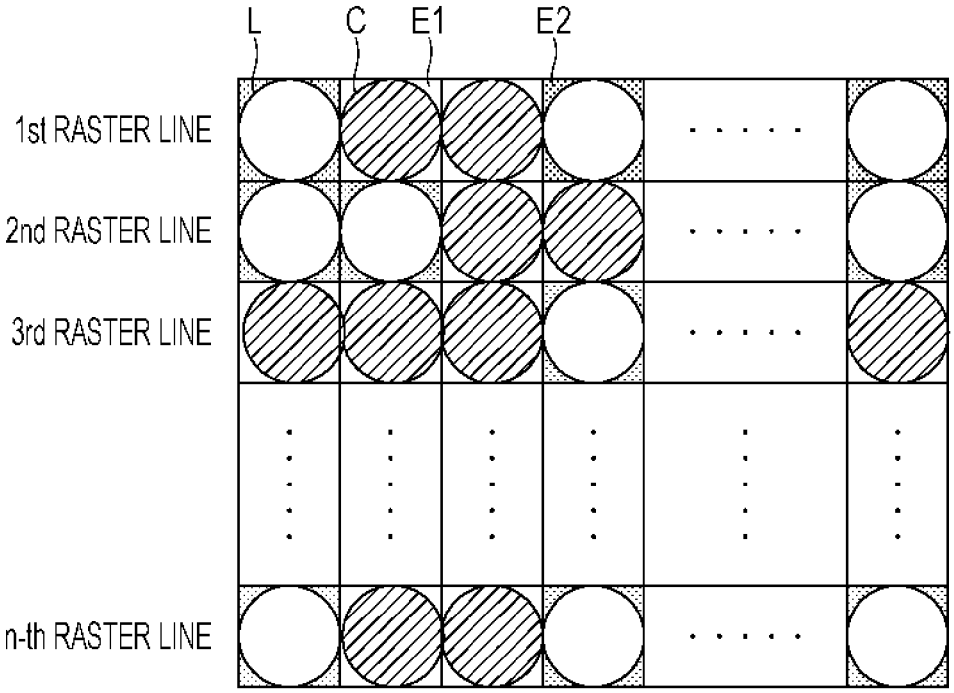
FIG. 5B is a diagram illustrating ejection operation of an ancillary liquid and an image forming liquid according to an embodiment of the invention.
Figure 6A:
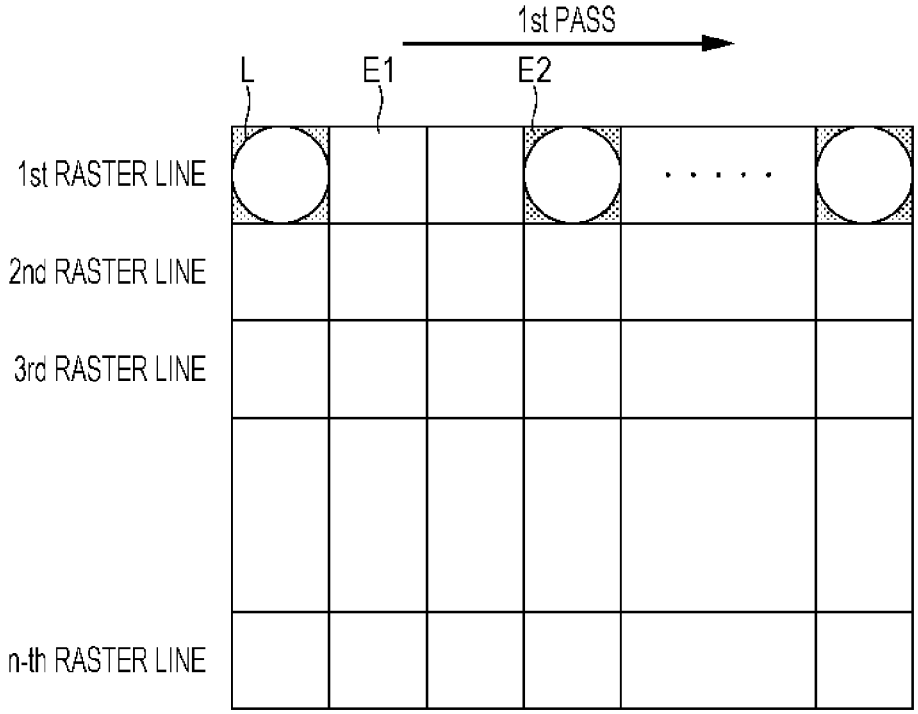
FIG. 6A is a diagram illustrating another example of ejection operation of an ancillary liquid and an image forming liquid according to an embodiment of the invention.
Figure 6B:
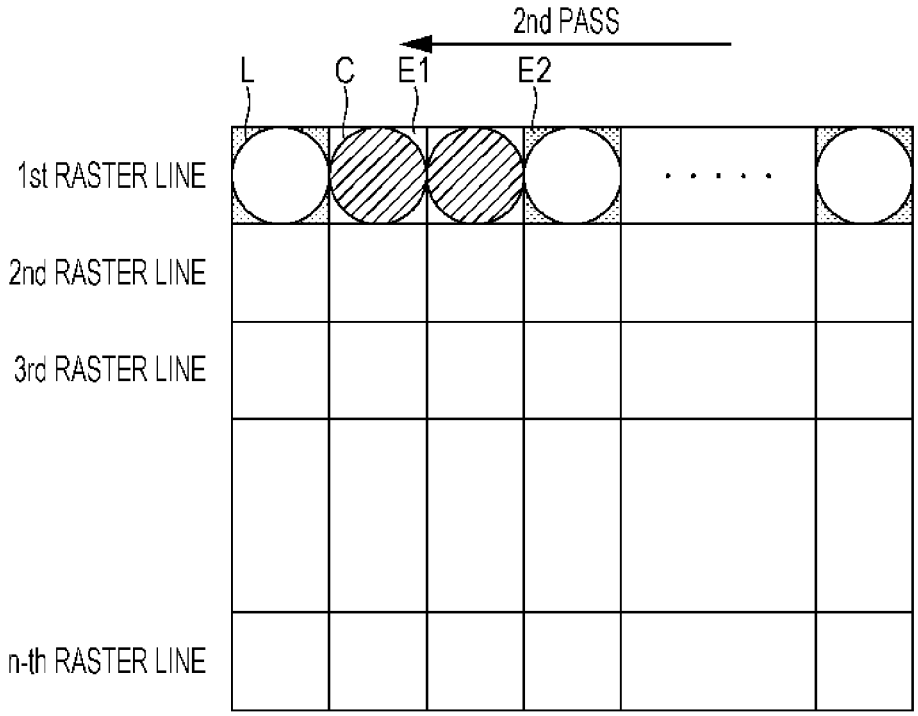
FIG. 6B is a diagram illustrating another example of ejection operation of an ancillary liquid and an image forming liquid according to an embodiment of the invention.
Figure 6C:
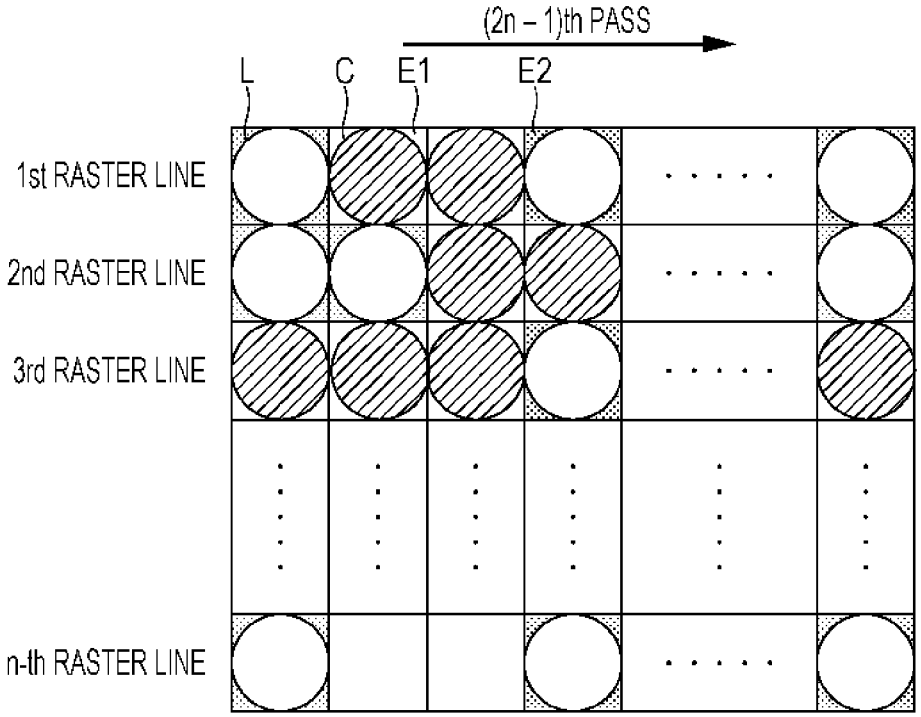
FIG. 6C is a diagram illustrating another example of ejection operation of an ancillary liquid and an image forming liquid according to an embodiment of the invention.
Figure 6D:
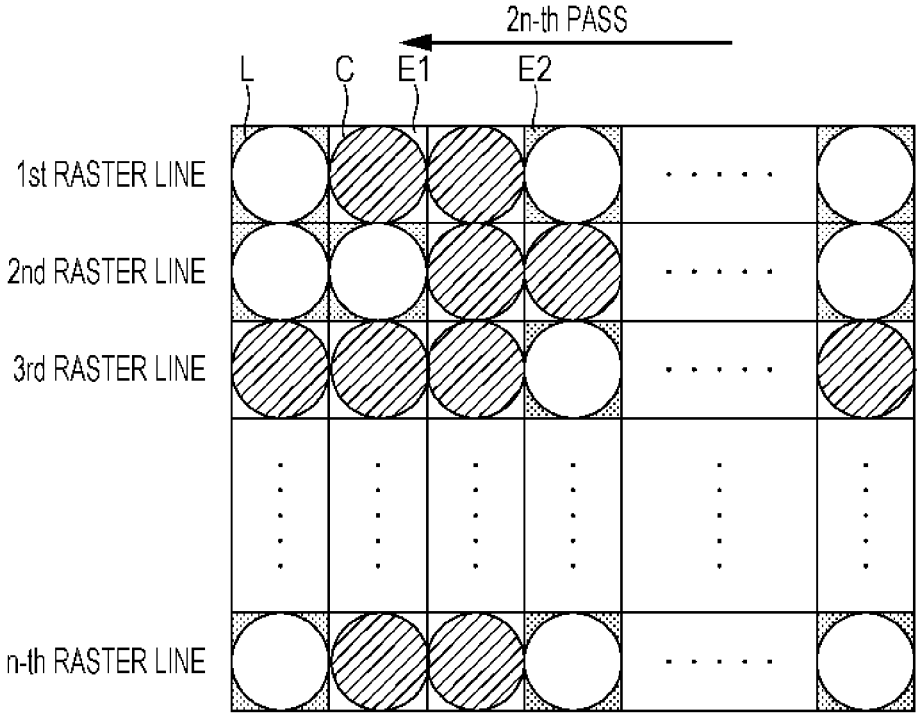
FIG. 6D is a diagram illustrating another example of ejection operation of an ancillary liquid and an image forming liquid according to an embodiment of the invention.

In a specific example, first, the head 21 ejects the ancillary liquid L onto the second region E2 while moving from an initial position (for example, an upper-left position of a printing medium shown in FIG. 5A) two-dimensionally relative to the printing medium. In this case, dots of the ancillary liquid L are formed on the second region E2 of the printing medium staying at the printing position (refer to FIG. 5A).

Next, the head 21 ejects necessary ones of the image forming liquids C onto the first region El while moving anew from the initial position two-dimensionally relative to the printing medium. In this case, dots of the at least one of the image forming liquids C are formed on the first region E1 of the printing medium staying at the printing position (refer to FIG. 5B).

In this example, when deeming, as a single pass, an operation of allowing the head 21 to form dots on the printing medium staying at the printing position by ejecting liquids thereonto while two-dimensionally moving from the initial position, the operation (pass) of ejecting the ancillary liquid L is performed in a pass anterior to the operation (pass) of ejecting necessary ones of the image forming liquids C. Conversely, the operation (pass) of ejecting at least one of the image forming liquids C is performed in a pass posterior to the operation (pass) of ejecting the ancillary liquid L. That is, when focusing attention on the printing medium staying at the printing position, the second operation is performed in the anterior pass, and the first operation is performed in the posterior pass.

Such ejection of the ancillary liquid L onto only the second region E2 makes it possible to efficiently form layers of the ancillary liquid L on the printing medium. Further, a region onto which the ancillary liquid L is ejected (i.e., the second region E2) and a region onto which necessary ones of the image forming liquids C are ejected (i.e., the first region E1) are different from each other, and thus, the ancillary liquid L is hard to be mixed with any of the image forming liquids C.

Moreover, the ancillary liquid L is ejected in a pass prior to the pass in which necessary ones of the image forming liquids C are ejected, that is, the ancillary liquid L is ejected in the anterior pass. In this case, the ejected ancillary liquid L becomes in a dry state by being subjected to heat from the hot platen 41 and the like before beginning of the posterior pass in which necessary ones of the image forming liquids C are ejected. Accordingly, even when a certain one of the image forming liquids C has been ejected onto a position close to the ancillary liquid L, these two kinds of liquids are unlikely to be mixed with each other. That is, it is possible to reduce the blurs on images.

Further, causing the ancillary liquid L to be ejected in the anterior pass makes it possible to cause the amounts of electrostatic charges on the surface of the printing medium to be uniform before ejecting necessary ones of the image forming liquids C (before performing the posterior pass). Accordingly, it is possible to reduce the influence of satellites which occur when any one of the image forming liquids C has been ejected.

There is another method in ejection operation control according to this embodiment. For example, in a first pass, the head 21 ejects the ancillary liquid L onto the second region E2 included in a region corresponding to a 1st raster line (refer to FIG. 6A). In this case, in the 1st raster line, layers of the ancillary liquid L are formed on the second region E2. Next, in a second pass, the head 21 ejects necessary ones of the image forming liquids C onto the first region El included in the region corresponding to the 1st raster line (refer to FIG. 6B). Similarly, in $(2n-1)$th pass, the head 21 ejects the ancillary liquid L onto the second region E2 included in a region corresponding to an n-th raster line (refer to FIG. 6C), and in a 2n-th pass, the head 21 ejects necessary ones of the image forming liquids C onto the first region E1 included in the region corresponding to the n-th raster line (refer to FIG. 6D).

In this example, in a single raster line, the operation (pass) of ejecting the ancillary liquid L is performed in a pass anterior to the operation (pass) of ejecting necessary ones of the image forming liquids C. Conversely, the operation (pass) of ejecting necessary ones of the image forming liquids C is performed in a pass posterior to the operation (pass) of ejecting the ancillary liquid L. That is, when focusing attention on a single raster line (for example, an n-th raster line), the second operation is performed in an anterior pass (for example, a $(2n-1)$th pass), and the first operation is performed in a posterior pass (a 2n-th pass).

In addition, in FIGS. 6A to 6D, in order to make it easy to understand description therefor, an example in which the ejection of the ancillary liquid L (necessary ones of the image forming liquids C) is performed, in a single pass, onto a region corresponding to a single raster line has been described. Meanwhile, for example, in the case where a head including a plurality of nozzles n, as shown in FIG. 3, is used, the ejection of the ancillary liquid L (necessary ones of the image forming liquids C) can be simultaneously performed, in a single pass, onto a region corresponding to a plurality of raster lines.

Further, in FIGS. 6A to 6D, an example in which the liquid ejection is performed in each of reciprocating passes (for example, 1st and 2nd passes) has been described, but the method is not limited to this. For example, it is possible to perform the liquid ejection only one of the reciprocating passes, such as a 1st pass, a 3rd pass, . . . . In this case, it is possible to ensure a further period of time for drying the liquids having been ejected. Thus, it is possible to further reduce the occurrence of the mixture between a certain one of the image forming liquids C and the ancillary liquid L.

Operation of Ink jet Printer

Figure 7:
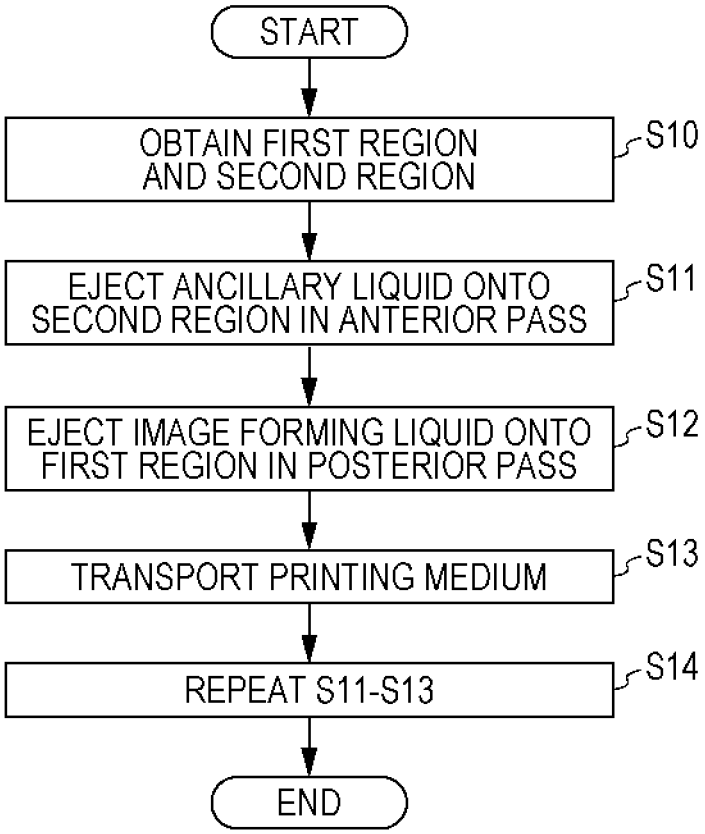
FIG. 7 is a flowchart illustrating operation of a printing apparatus according to an embodiment of the invention.

Operation of the ink jet printer 1 of this embodiment will be described with reference to FIG. 7.

First, the controller 60 obtains the first region E1 and the second region E2 by analyzing image data (S10).

The controller 60 performs control of the head 21 on the basis of a result obtained in S10 so as to cause the head 21 to eject necessary ones of the image forming liquids C and the ancillary liquid L onto a printing medium.

Specifically, the controller 60 performs control so as to cause the head 21 to eject the ancillary liquid L onto the second region E2 in an anterior pass (S11).

The controller 60 performs control so as to cause the head 21 to eject necessary ones of the image forming liquids C onto the region E1 in a pass posterior to the pass in S11 (S12).

When forming of images and ancillary liquid layers on the printing medium staying at the printing position has been completed, the controller 60 transports the printing medium and causes a region on which any image is not yet formed to stay at the printing position (S13).

The controller 60 repeats these processes of S11 to S13 until the completion of forming of a desired number of images (S14).

Other Embodiments

The aforementioned embodiment is intended to make it easy to understand the invention, and is not intended to limit the interpretation of the invention. The invention can be modified and improved without departing from the spirit of the invention, and obviously, equivalents thereof are included in the scope of the invention. Particularly, embodiments described below are ones to be included in the scope of the invention.

The configuration of the head 21 is not limited to that shown in FIG. 3. The head 21 is sufficient, provided that the head 21 is configured so as to be capable of performing the liquid ejection operation based on the control of the controller 60, having been described in the above embodiment.

The hot platen 41 and the drying mechanism 42 are sufficient, provided that the hot platen 41 and the drying mechanism 42 are configured so as to be capable of drying liquids (inks) forming images and ancillary liquid layers which have been formed on a printing medium. Thus, the hot platen 41 and the drying mechanism 42 may be configured so as to apply, for example, hot air, infrared rays or electromagnetic waves, such as micro-waves, to the printing medium. Alternatively, in the case where an ultraviolet (UV) hardening type ink is employed, the hot platen 41 and the drying mechanism 42 may be configured so as to irradiate the printing medium with an ultraviolet ray.

Further, sometimes, as an image to be printed on a printing medium, there is used an image having display colors whose contrasting density, brightness, hue and the like continuously vary (i.e., a so-called gradation image), or an image having outlined characters on a background formed in black (solid black) or the like (i.e., a so-called outline character image).

For these images, it is difficult to discriminate between a region on which necessary ones of the image forming liquids C are to be ejected (i.e., the first region E1) and a region on which any of the image forming liquids C is not to be ejected (i.e., the second region E2).

Accordingly, for example, in such an outline character image, in the case where the first region E1 is determined so as to include outlined portions, the controller 60 does not cause the ancillary liquid L to be ejected onto the outlined portions. Thus, in this case, satellites are accumulated on the outlined portions, so that image degradations are likely to occur. Accordingly, in the case where such an image is formed, it is desirable to eject the ancillary liquid L onto the first area E1 and the second area E2.

Figure 8:
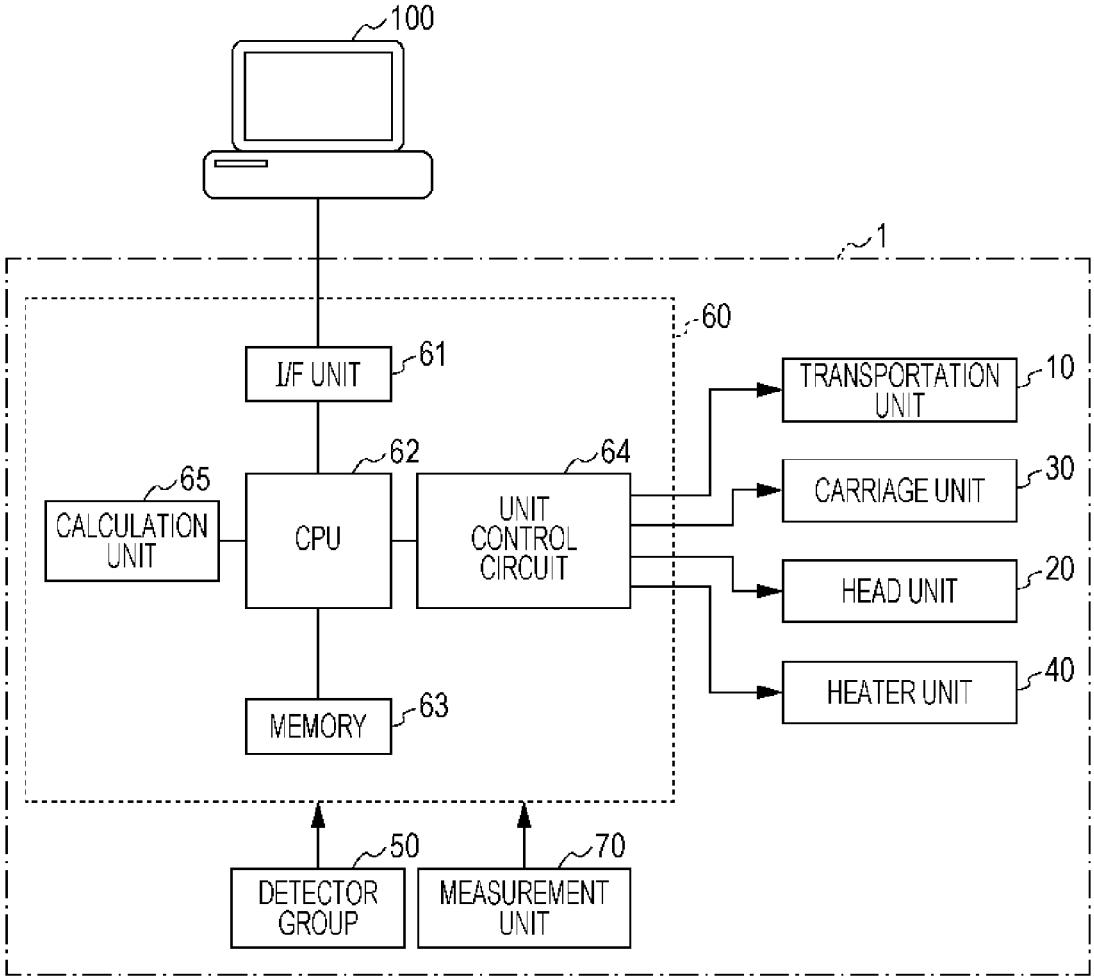
FIG. 8 is a diagram illustrating a printing apparatus according to another embodiment of the invention.

FIG. 8 is a block diagram illustrating the whole configuration of the ink jet printer 1 of an embodiment for such a case. As shown in FIG. 8, in this embodiment, the controller 60 is configured so as to include a calculation unit 65.

This calculation unit 65 calculates a coverage ratio of images on a printing medium on the basis of image data corresponding to the images. The coverage ratio means a ratio representing a proportion (percentage) of a region occupied by images in a printing region.

Specifically, the coverage ratio is a value (percentage) resulting from dividing the number of dots included in the first region E1 by the number of dots included in the first region E1 and the second region E2. Further, the coverage ratio can be obtained on the basis of a liquid ejection amount per dot (in the case where an amount of a liquid to be ejected onto a single dot is constant). Alternatively, the coverage ratio can be obtained as a value resulting from dividing an area of a pixel region corresponding to the first region E1 (i.e., an area of a region in which images are formed) by an area of a pixel region corresponding to the first region E1 and the second region E2 (i.e., an area of a printing region).

For example, in the case where four images are formed on a printing medium staying at the printing position, the calculation unit 65 obtains a proportion of a region occupied by the images on the printing medium staying on the printing position by dividing the number of dots corresponding to the four images by the number of dots corresponding to the entire printing medium staying at the printing position (i.e., the number of dots corresponding to a printing region).

In the case where the proportion (the coverage ratio) having been obtained by the calculation unit 65 is smaller than or equal to a threshold value, the controller 60 performs control so as to cause the head 21 to also eject the ancillary liquid onto the first region E1. The threshold value is a value for use in a determination as to whether or not the ancillary liquid L is also to be applied to the first region E1. With respect to the threshold value, for example, a value of thirty to forty percent is set thereto.

Such an adjustment based on coverage ratios with respect to regions onto which the ancillary liquid L is to be ejected makes it possible to form the layers of the ancillary liquid L in accordance with images to be printed. Accordingly, even when a particular image, such as a gradation image or an outline character image, is printed, it is possible to reduce the influence of satellites.

Moreover, for example, when humidity is low in a winter season or the like, there is a possibility in that a preset amount of ejection of the ancillary liquid becomes insufficient to cause the amounts of electrostatic charges to be uniform. In this case, it is also possible to provide a plurality of modes in which their respective amounts of ejection of the ancillary liquid in the second operation are mutually different.

For example, it is supposed that there are provided a first mode in which a predetermined amount of the ancillary liquid is ejected, and a second mode in which an amount of the ancillary liquid which is more than that of the first mode is ejected. These modes are stored in the memory 63. The selection of any one of these modes can be made automatically or manually.

In the case where the selection is made automatically, for example, the controller 60 compares a value (percentage) of humidity having been measured by the measurement unit 70 with a preset condition (for example, the first mode: larger than or equal to 30 percent, and the second mode: smaller than or equal to 29 percent). For example, in the case where the measured humidity is 10 percent, the controller 60 selects and carries out the second mode.

Meanwhile, in the case where the selection is made manually, for example, an operator of the jet printer 1 confirms a value indicated by a hygrometer equipped inside a room. In the case where the value indicated by the hygrometer is small (for example, humidity is 10 percent), the operator can determine that a possibility of the occurrence of electrostatic charges on a printer medium is high. In this case, the operator selects the second mode having been set in advance via an input portion (not illustrated) of the ink jet printer 1. The controller 60 carries out the selected second mode.

In addition, when selecting the first mode or the second mode, conditions other than the humidity may be taken into consideration. For example, depending on kinds of images to be printed and a required image quality, there is a case where the influence of satellites may not be taken into consideration. Alternatively, in general, cost of a clear ink is higher than that of a color ink, and thus, when taking into consideration cost of the entire printing operation, there is also a case where it is desired to reduce an amount of consumption of the clear ink. In such a case, for example, the operator sets the first mode via the input portion (not illustrated) of the ink jet printer 1. The controller 60 carries out the first mode having been set, regardless of conditions such as humidity.

Further, instead of providing such particular modes, a method of increasing an amount of ejection of the ancillary liquid can be also considered.

In this case, for example, the controller 60 compares the result of the measurement performed by the measurement unit 70 with a predetermined threshold value. This predetermined threshold value is a value for use in a determination as to whether or not the amount of ejection of the ancillary liquid is to be increased (for example, the value being based on such a humidity that is smaller than or equal to 19 percent).

In the case where the humidity having been measured by the measurement unit 70 is smaller than or equal to a threshold value, the controller 60 performs control so as to cause the head 21 to increase the amount of ejection of the ancillary liquid. With respect to an amount of the increase of the ancillary liquid, a predetermined value is set thereto in advance.

Figure 9:
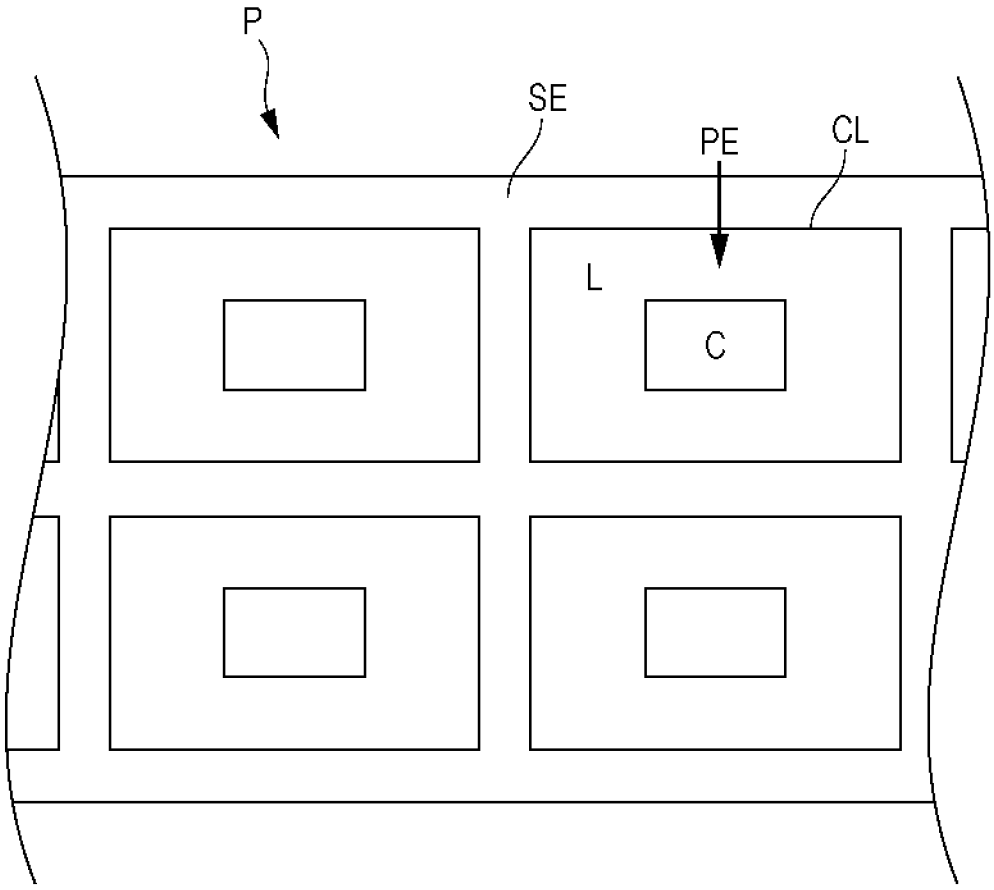
FIG. 9 is a diagram illustrating a printed material according to another embodiment of the invention.

Further, FIG. 9 is a schematic diagram, illustrating an example of printed materials P having been printed by the ink jet printer 1. As shown in FIG. 9, among the printed materials P, there is also a printed material on which a printing region PE and a region SE are formed, the printing region PE being a region on which necessary ones of the image forming liquids C and the ancillary liquid L are ejected, the region SE being a region on which any of the image forming liquids C is not ejected (that is, the region SE being the second region E2) and which is to be detached after the completion of forming of images.

In this case, when there exists the area SE to be detached, the controller 60 performs control so as to cause the head 21 not to perform the second operation (i.e., ejection of the ancillary liquid L) onto the relevant region SE to be detached. Specifically, the controller 60 preliminarily sets the printing region PE corresponding to a printing medium staying at the printing position on the basis of the size of the printing medium, the number of images to be printed, image data specifying images to be printed, and the like. The controller 60 performs printing on the printing region PE.

Meanwhile, in the case where there exists a region other than the region PE having been set, the controller 60 determines that the relevant region is the region SE to be detached. The controller 60 performs control so as to cause the head 21 to not to eject the ancillary liquid L onto the region SE to be detached. In addition, a boundary between the printing region PE and the region SE to be detached is called a cut line CL. This cut line CL can be determined on the basis of image data or the like.

As described above, it is possible to reduce the influence of satellites by causing the distributed amounts of electrostatic charges to be uniform. Nevertheless, actually, in conjunction with the uniformization of the distributed amounts of electrostatic charges, distributed amounts of the satellites are also merely made uniform and the satellites remain accumulated on a printing region. Thus, a portion in which the distributed amounts of electrostatic charges are not uniform is daringly made remain without ejecting the ancillary liquid onto the region SE to be detached, and thereby it is possible to cause the satellites to be selectively accumulated on the relevant portion (the region SE to be detached). Thus, it is possible to further reduce the influence of the satellites in the printing region PE.

Further, the image forming liquid and the ancillary liquid each may be an aqueous ink, or may be an oil-based ink.

Further, the liquid is not limited to ink, and a liquid other than the ink (besides the liquid, a liquid material in which particles of functional materials are dispersed and a fluid material such as a gel material are included) as well as a fluid material other than the liquid (a solid capable of being flowed and ejected as a fluid material is included) can be also used.

The configuration of the aforementioned embodiment can be also applied to a line printer and an ink jet printer based on a serial scanning method. This serial scanning method is a method in which images are formed by repeatedly performing a series of operations of ejecting liquids and transporting a printing medium. That is, in the case where images are formed by means of the serial scanning method, forming of images based on image data is not yet completed at the time of resuming the operation of transporting a printing medium. As the ink jet printer based on the serial scanning method, for example, there exists a large format printer (LFP).

The entire disclosure of Japanese Patent Application No. 2013-065800, filed Mar. 27, 2013 is expressly incorporated by reference herein.

What is claimed is:

1. A printing apparatus comprising:

a head configured to eject, onto a printing medium, an image forming liquid for forming an image and an ancillary liquid ancillary to forming of the image performed by the image forming liquid, wherein the head is configured to move in a first direction and a second direction intersecting the first direction; and a control unit configured to perform control so as to cause the head to perform a first operation of ejecting the image forming liquid onto a first region of the printing medium, and a second operation of ejecting the ancillary liquid onto a second region of the printing medium, the second region being different from the first region, wherein the control unit controls the head to perform the second operation during each anterior pass of the head and perform the first operation during each posterior pass of the head.

2. The printing apparatus according to claim 1, wherein the control unit includes a calculation unit for calculating a coverage ratio of the image on the printing medium on the basis of image data corresponding to the image, and in the case where the coverage ratio is smaller than or equal to a threshold value, the control unit performs control so as to cause the head to also eject the ancillary liquid to the first region.

3. The printing apparatus according to claim 1, wherein the control unit is capable of selectively performing a plurality of modes which are mutually different in an amount of ejection of the ancillary liquid in the second operation.

4. The printing apparatus according to claim 1, further comprising:

a measurement portion configured to measure humidity of the printing medium, wherein, in the case where a result of the measurement performed by the measurement portion is smaller than or equal to a threshold value, the control unit performs control so as to cause the head to increase an amount of ejection of the ancillary liquid.

5. The printing apparatus according to claim 1, wherein, in the case where there exists a region which is the second region and is to be detached after subjected to printing of the image, the control unit performs control so as to cause the head not to perform the second operation on the region to be detached.

* * * * *